US006059280A

United States Patent [19]

Yamauchi et al.

[11] Patent Number: 6,059,280

[45] **Date of Patent: *May 9, 2000**

[54] ROLLER SUPPORTING DEVICE ALLOWING EASY REPLACEMENT OF SEPARATING ROLLER

[75] Inventors: Tsuyoshi Yamauchi, Yokohama; Akimitsu Hoshi, Kawasaki; Yukitoshi Takeuchi, Yokohama, all of Japan

[73] Assignee: Canon Kabushiki Kaisha, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/771,278

[22] Filed: Dec. 20, 1996

[30] Foreign Application Priority Data

Jan. 9, 1996 [JP] Japan ..... 8-018078

[51] Int. Cl.[7] ..... B65H 3/06

[52] U.S. Cl. ..... 271/109; 271/122; 271/125; 271/272; 271/273; 271/274; 193/35 R; 193/37; 198/780

[58] Field of Search ..... 271/122, 125, 271/272–274; 193/35 R, 37; 198/780

[56] References Cited

U.S. PATENT DOCUMENTS

| | | | |
|---|---|---|---|
| 4,059,180 | 11/1977 | Krivec et al. | 193/37 |
| 4,717,134 | 1/1988 | Iida et al. . | |
| 4,872,661 | 10/1989 | Knepper | 271/273 |
| 4,883,265 | 11/1989 | Iida et al. . | |
| 5,203,552 | 4/1993 | Hoshi et al. . | |
| 5,421,442 | 6/1995 | Agnoff | 193/37 |
| 5,769,410 | 6/1998 | Davidson et al. | 271/273 X |

FOREIGN PATENT DOCUMENTS

| | | | |
|---|---|---|---|
| 61893 | 10/1982 | European Pat. Off. | 193/37 |
| 2300079 | 7/1974 | Germany | 193/37 |
| 56742 | 4/1985 | Japan | 271/122 |

*Primary Examiner*—Christopher P. Ellis
*Assistant Examiner*—Richard Ridley
*Attorney, Agent, or Firm*—Fitzpatrick, Cella, Harper & Scinto

[57] ABSTRACT

A shaft portion of a retard roller is supported by a pair of supporting members so that the retard roller can be assuredly supported and easily detached. One of the pair of supporting members is provided so as to be movable in the axial direction of the shaft portion. By moving the movable supporting member in a direction of separating from the shaft portion, the retard roller can be detached. A regulation device regulates movement of the movable supporting member in the direction of separating from the shaft portion at a position where the pair of supporting members engage with the shaft portion and is provided on a guide cover for blocking an opening for mounting/detaching the retard roller.

21 Claims, 15 Drawing Sheets

ROLLER SUPPORTING DEVICE ALLOWING EASY REPLACEMENT OF SEPARATING ROLLER

BACKGROUND OF THE INVENTION

1. Field of the Invention

This invention relates to a device for supporting various kinds of rollers for conveying a sheet material, to a sheet-material feeding device in which such a roller supporting device is used as a separation rotating member of a separation conveying unit, to an original-reading device in which such a sheet-material feeding device is applied to a unit for feeding a sheet-like original, and to an image recording apparatus, such as a copier, a printer or the like, in which such a sheet-material feeding device is applied to a unit for feeding a sheet material for recording.

2. Description of the Related Art

An automatic original-feeding device, serving as an example of the above-described sheet-material feeding device, used in an original-reading apparatus is configured as shown in FIGS. 13(*a*) and 13(*b*). That is, the automatic original-feeding device includes a pickup roller 102 for feeding a plurality of sheet-like originals 101 mounted on a sheet-material mounting unit 100, and a separation conveying unit 104 for individually separating the unseparated originals 101 fed by the pickup roller 102 and conveying each of the separated originals to a reading unit 103 provided downstream of pickup roller 102.

The separation conveying unit 104 is a so-called retard roller separation system (or method), and comprises a feed roller 105 for conveying the original 101 toward the downstream side in the feeding direction, and a retard roller 106, serving as reverse-rotation separation means, rotatably driven in a direction opposite to the feeding direction of the original 101 and in pressure contact with the feed roller 105 with a predetermined pressure.

The retard roller 106 is rotatably supported on a pair of supporting levers 109, 109 swingably mounted on a supporting shaft 108 provided between a pair of protruded pieces 107*a*, 107*a* of a bracket 107.

A roller shaft 110 is threaded through the retard roller 106, and the retard roller 106 is integrally fixed on the roller shaft 110 by parallel pins (not shown). Both ends of the roller shaft 110 are rotatably supported on swinging ends of the pair of supporting levers 109, 109.

The supporting lever 109 has an L-like shape, and the bending portion of the supporting lever 109 is pivoted on the supporting shaft 108. The retard roller 106 is rotatably supported on one swinging end of the supporting lever 109, and a connection shaft 111 is inserted between the other swinging ends of the supporting levers 109, 109. A pressing lever 112 for pressing the supporting levers 109 via the connection shaft 111 to make the retard roller 106 in pressure contact with the feed roller 105 is provided on the supporting shaft 108. The pressing lever 112 is urged in a predetermined direction by a spring member 115.

The movement of the roller shaft 110, the supporting shaft 108 and the connection shaft 111 in the axial direction is regulated by stop rings 160, each comprising an E-ring or the like.

In the above-described conventional structure, the feed roller 105 is exposed and can be exchanged when an upper opening/closing guide is opened. However, the retard roller 106 is exchanged in a different manner. That is, first, as shown in FIG. 14, a white guide member 114 incorporated within a main body 161 of the device screwed at four points is exposed. The white guide member 114 serves as the background of the reading unit 103. Then, the white guide member 114 screwed at two points is separated from the main body 161 of the device to expose a bracket 107 incorporated inside the main body 161 of the device, and the bracket 107 is separated by removing screws at the two points. In order to take out the retard roller 106 from the bracket 107, it is necessary to separate the five stop rings 160, the spring member 115, the roller shaft 110, the supporting shaft 108, the connection shaft 111, the supporting levers 109 and the pressing lever 112.

Accordingly, it is almost impossible for the user to exchange the retard roller 106, and a serviceman for performing maintenance is required. Since it is almost impossible for the user to exchange the retard roller 106, the life of the entire device for typical maintenance free products is determined by the life of the retard roller 106.

In order to solve such a problem, an approach as shown in FIG. 15 can be considered. That is, the roller shaft for suppporting the retard roller 106, serving as the main body of the roller, is divided into right and left supporting shafts 121 and 122, and the one supporting shaft 121 is made to be slidable in the thrust direction. The movable supporting shaft 121 is urged by a spring member 123 toward the retard roller 106 to support it, and an opening 125 capable of receiving the retard rollers 106 is provided in a guide member 124. Thus, the retard roller 106 can be detached by moving the movable supporting shaft 121 against the urging force of the spring member 123 through the opening 125 provided in the guide member 124, without disassembling the device as in the conventional structure.

In this case, however, since the movable supporting shaft 121 is supported only by the urging force of the spring member 123, the retard roller 106 may detach due to vibration or the like. Furthermore, since the supporting shaft 121 is always urged in the thrust direction, an unnecessary load torque may be produced in the retard roller 106.

SUMMARY OF THE INVENTION

The present invention has been made in consideration of the above-described problems.

It is an object of the present invention to provide a roller supporting device which allows easy exchange of the main body of a roller and which can assuredly support the main body of the roller, to provide a sheet-material feeding device which allows for the user to easily exchange a rotating member for separation without requiring a serviceman, and to provide an original-reading apparatus or an image recording apparatus which uses such a roller supporting device.

Thus, the life of the entire device is not determined by the life of the rotating member for separation even if the rotating member for separation is used for a maintenance free product.

According to one aspect of the present invention which achieves the above-described objects, there is a roller supporting device for supporting a roller having a shaft portion with two ends and a roller portion on a main body of the device, comprising a pair of supporting members for supporting the roller by each engaging with a respective end of the shaft portion. At least one of the pair of supporting member is a movable supporting member provided so as to be movable in the axial direction of the shaft portion so that the roller can be detached by moving the movable supporting member in a separating direction to separate it from the shaft portion. Regulation means for regulating the movement of the movable supporting member in the separating direction at a position where the pair of supporting members engage with the shaft portion is provided so as to be detachable relative to the main body of the device.

According to another aspect of the present invention which achieves the above-described objects, there is a sheet feeding device, having conveying rotation means rotating in a direction of feeding sheets, and reverse-rotation separation means, rotating in a direction opposite to the sheet feeding direction, for individually separating the sheets between the conveying rotation means and the reverse-rotation separation means and for feeding each of the separated sheets. A pair of supporting members for supporting the reverse-rotation separation means by engaging with both ends of a shaft portion thereof is provided at a main body of the sheet feeding device. At least one of the pair of supporting members is a movable supporting member provided so as to be movable in the axial direction of the shaft portion so that the reverse-rotation separation means can be detached by moving the movable supporting member in a separating direction to separate it from the shaft portion. Regulation means for regulating the movement of the movable supporting member in the separating direction at a position where the pair of supporting members engage with the shaft portion is provided so as to be detachable relative to the main body of the device.

According to still another aspect of the present invention which achieves the above-described objects, there is a sheet processing device, comprising conveying rotation means rotating in a direction of feeding sheets, reverse-rotation separation means rotating in a direction opposite to the sheet feeding direction, and a sheet processing unit for individually separating the sheets between the conveying rotation means and the reverse-rotation separation means and for feeding each of the separated sheets. A pair of supporting members for supporting the reverse-rotation separation means by engaging with both ends of a shaft portion thereof is provided at a main body of the sheet processing device. At least one of the pair of supporting members is a movable supporting member provided so as to be movable in the axial direction of the shaft portion so that the reverse-rotation separation means can be detached by moving the movable supporting member in a direction of separating from the shaft portion. Regulating means for regulating the movement of the movable supporting member in the separating direction of separating from the shaft portion at a position where the pair of supporting members engage with the shaft portion is provided so as to be detachable relative to the main body of the device.

The foregoing and other objects, advantages and features of the present invention will become more apparent from the following detailed description of the preferred embodiment taken in conjunction with the accompanying drawings.

BRIEF DESCRIPTION OF THE DRAWINGS

FIG. 1(*a*) is an exploded perspective view; and FIGS. 1(*b*) and 1(*c*) are cross-sectional views;

FIG. 2(*a*) is a schematic perspective view illustrating a state in which a guide cover is removed; and FIG. 2(*b*) is a schematic perspective view illustrating a state in which the guide cover is closed;

FIG. 7(*b*) is an enlarged view illustrating the vicinity of a film;

FIG. 8(*b*) is a diagram briefly illustrating a start-stop sequence and a step-down sequence during a reading operation;

FIGS. 12(*b*) and 12(*c*) are cross-sectional views of a stopper tab;

FIG. 13(*b*) is a schematic prespective view of a retard roller;

DETAILED DESCRIPTION OF THE PREFERRED EMBODIMENT

A preferred embodiment of the present invention will now be described with reference to the drawings.

Figure 1A:
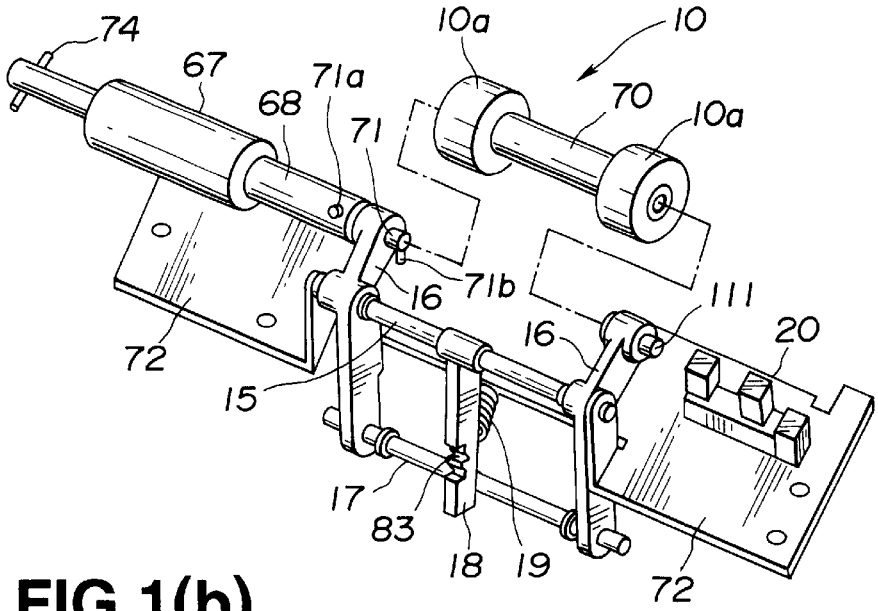
FIGS. 1(*a*) through 1(*c*) illustrate a roller supporting device for supporting a retard roller for separation according to an embodiment of the present invention.
Figure 1B:
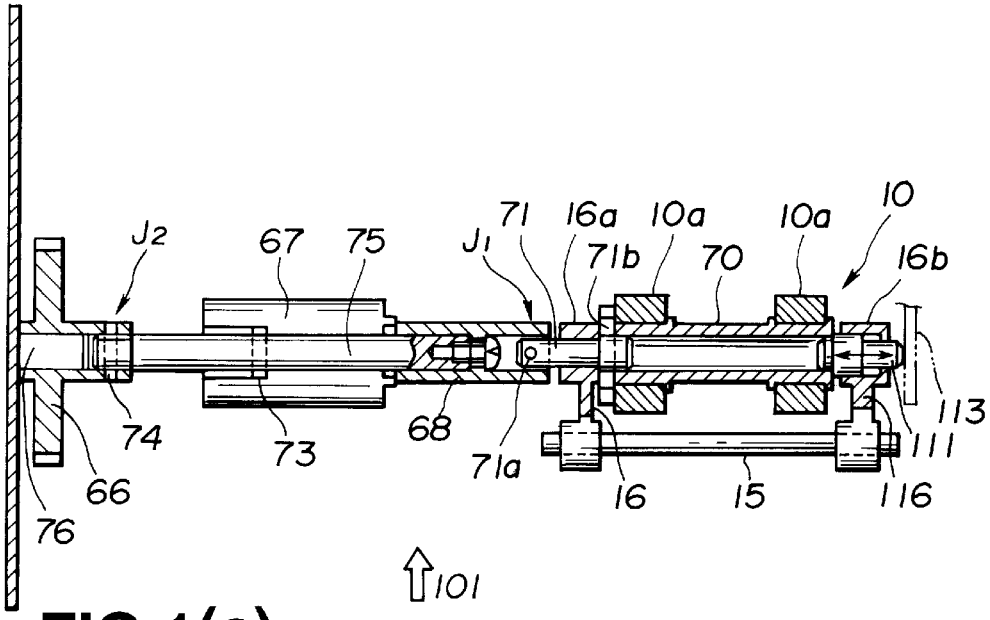
Figure 1C:
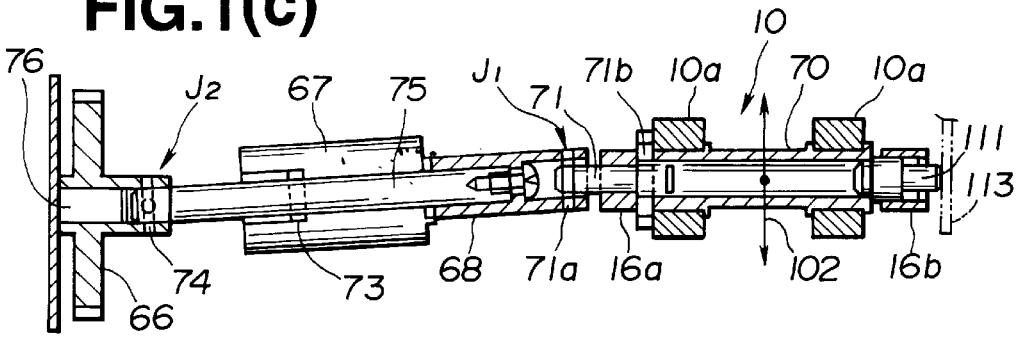

FIGS. 1(*a*) through 12(*c*) illustrate the configuration of the preferred embodiment.

Figure 4:
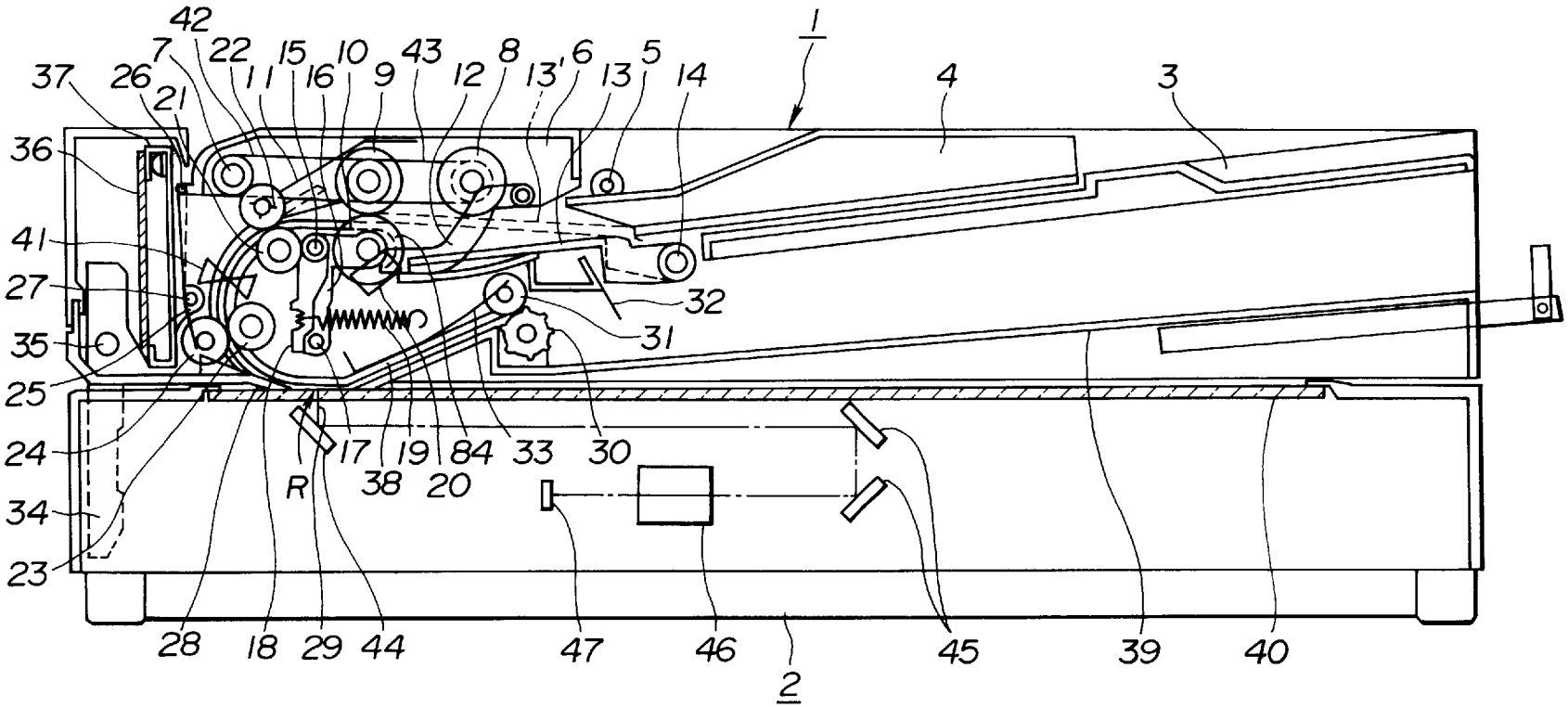
FIG. 4 is a cross-sectional view illustrating the entire configuration of an original-reading device according to the embodiment.

FIG. 4 is an entire cross-sectional view obtained by cutting an original-reading device according to the embodiment along a plane passing through the center of a lens 46.

In FIG. 4, an original-feeding device (ADF (automatic document feeder)), serving as a sheet-material feeding device of the embodiment, separates sheet-like originals, serving as a sheet material, mounted in a face-up state (a state in which the reading surface of each of the originals is placed upward) from the uppermost original and feeds each of the separated originals to an image reading portion R of a main body 2 of a scanner, performs running reading of an image on the original in accordance with the movement of the original, and discharges the read original.

The main body 2 of the scanner is a flat-bed type, and scans and reads the image of the original mounted on platen glass 40, converts the read image into digital information, and transmits the obtained image information to a computer.

Reference numeral 3 represents an original-feeding tray of the original-feeding device 1 for mounting a plurality of originals to be fed.

A pair of side regulation guides 4 are provided at both ends of the originals in the lateral direction in order to prevent skew of the originals by pressing the originals on the original-feeding tray 3 from a direction orthogonal to the sheet feeding direction. Each of the side regulation guides 4 has substantially a ⊐-like cross section. That is, a roof portion for pressing the originals from above is provided in order to prevent end portions of the originals from lifting to cause skew of the originals.

The shaft 5 represents a swinging center of the original-feeding tray 3. When taking out originals on a discharged-sheet tray 39 or performing jam removing processing, the side regulating guides 4 and the original-feeding tray 3 are rotated around the swinging shaft 5.

An upper opening/closing guide 6 serves as a member for guiding the upper surface of the fed originals, and is rotatable around a shaft 7.

The shaft 7 is the swinging center of the upper opening/closing guide 6, and is also used as a driving shaft for driving a pickup roller 8 and a feed roller 9 mounted on the upper opening/closing guide 6.

The pickup roller 8 sequentially feeds the originals mounted on the original-feeding tray 3 into the device from the uppermost original. The pickup roller 8 is rotatably fixed on the upper opening/closing guide 6.

The feed roller 9 serves as conveying rotation means. A retard roller 10 serves as a reverse-rotation separation means which rotates in a direction opposite to the direction of rotation of the feed roller 9. The feed roller 9 and the retard roller 10 constitute a separation conveying unit. By the feed roller 9 and the retard roller 10, a plurality of originals supplied by the pickup roller 8 are individually separated, and each of the separated originals is conveyed toward the downstream side of the separation conveying unit.

The feed roller 9 is directly driven via a belt 42 from a pulley fixed on the driving shaft 7. The pickup roller 8 is driven via a belt 43 from the feed roller 9. The feed roller 9 is rotatably fixed on the upper opening/closing guide 6, as is the pickup roller 8.

As shown in detail in FIGS. 1(*a*)–1(*c*) and 3, the retard roller 10 comprises a hollow cylindrical roller shaft 70, and a pair of right and left roller portions 10*a*, 10*a*, made of a rubber-like elastic material, fitted on the outer circumference of the roller shaft 70. The retard roller 10 is supported by a pair of right and left retard-roller supporting levers 16 so as to be movable in a direction of approaching/leaving the feed roller 9, and is made in pressure contact with the feed roller 9 with a predetermined pressure by a spring member 19, serving as urging means.

Each of the retard-roller supporting levers 16 has an L-like shape. The bending portion of the retard-roller supporting lever 16 is rotatably supported on a shaft 15 fixed to a bracket 72. The retard roller 10 is supported on one swinging end of each of the respective retard-roller supporting levers 16, and the other of the swinging ends of the retard-roller supporting levers 16 are connected by a connection shaft 17. The retard roller 10 is pressed against the feed roller 9 by pressing the connection shaft 17 in a central area by a pressing lever 18 rotatably supported on the shaft 15.

Figure 3:
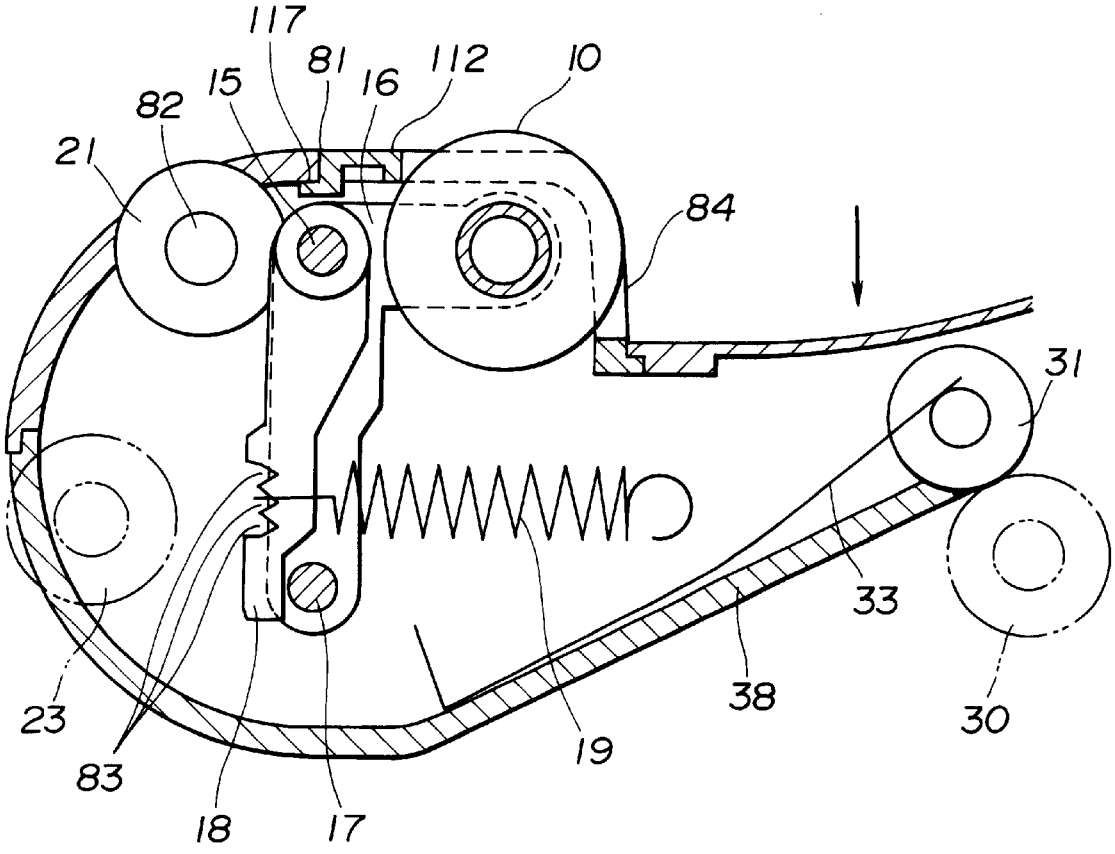
FIG. 3 is a schematic cross-sectional view illustrating the retard roller section.

The pressing lever 18 is drawn to the right in FIG. 3 by a spring 19, serving as urging means. Three notches 83 for anchoring the spring 19 are provided in the pressing lever 18. By changing the position where the spring 19 is anchored, the pressing force of the retard roller 10 can be adjusted.

FIG. 1(*b*) is a diagram illustrating the surrounding structure of the retard roller 10 as seen from above. The retard roller 10, serving as the main body of the roller, is equally supported by the pair of supporting levers 16 swinging around the shaft 15 by a fixed supporting shaft 71 and a movable supporting shaft 111, serving as a pair of supporting members. That is, a pin 71*a* fixed to one end of the fixed supporting shaft 71 engages with a slit provided in a pipe member 68 to provide a first universal joint J1.

On the other hand, a gear 66 for transmitting a driving force from a driving source (not shown) to the retard roller 10 is rotatably supported on a shaft 76 fixed on the frame of the device. One end of a transmission shaft 75 is fitted in an opening of an axial hole of the gear 66. A pin 74 is fixed to a fitting end of the transmission shaft 75, and a long hole provided in the gear 66 engages with the pin 74 to provide a second universal joint J2.

A torque limiter 67 fixed to another end of the transmission shaft 75 via a pin 73 engages with the pipe member 68 to transmit the torque of the torque limiter 67 to the retard roller 10.

Thus, the driving torque from the gear 66 is transmitted to the retard roller 10 via the torque limiter 67. The direction of the driving torque is opposite to the indicated original-feeding direction, i.e., is the direction to return the original.

FIG. 1(*c*) is a diagram obtained by viewing FIG. 1(*b*) from the direction of a block arrow 101.

As shown in FIG. 1(*c*), the retard roller 10, serving as the main body of the roller, moves in directions 102 (up and down directions) following the feed roller 9. The two universal joints J1 and J2 are bent to allow this movement.

As described above, both end portions of the retard roller 10, serving as the main body of the roller, are grasped by the fixed supporting shaft 71 and the movable supporting shaft 111, serving as the pair of supporting members. That is, the fixed supporting shaft 71 and the movable supporting shaft 111 are drawably inserted in openings, serving as engaging holes, at both ends of the roller shaft 70 of the retard roller 10.

The fixed supporting shaft 71 and the movable supporting shaft 111 are rotatably inserted in the first and second slide bearings 16*a* and 16*b* provided at the swinging ends of the left and right supporting levers 16, 16, respectively.

The fixed supporting shaft 71 inserted in the first slide bearing 16*a* is supported relative to the first slide bearing 16*a* so as not to be slidably movable in the axial direction and rotatable in the direction of rotation. A pin 71*b* fixed at an end portion of the fixed supporting shaft 71 facing the retard roller 10 engages with a notch 10*b* provided in the retard roller 10 so that the retard roller 10 and the fixed supporting shaft 71 are relatively detachable in the axial direction and not relatively rotatable in an engaged state.

On the other hand, the movable supporting shaft 111 is movable in the axial direction relative to the second slide bearing 16*b*. The range of the movement of the movable supporting shaft 111 is set between a roller engaging position where the distance between the fixed supporting shaft 71 and the movable supporting shaft 111 is shorter than the length of the roller shaft 70 of the retard roller 10, and a roller detaching position where the distance between the fixed supporting shaft 71 and the movable supporting shaft 111 is longer than the length of the roller shaft 70 of the retard roller 10.

By setting the distance between the fixed supporting shaft 71 and the movable supporting shaft 111 longer than the roller shaft 70 by moving the movable supporting shaft 111 so as to separate from the fixed supporting shaft 71, end portions of the roller shaft 70 are detached from the fixed supporting shaft 71 and the movable supporting shaft 111, and the retard roller 10 can be removed. By setting the distance between the fixed supporting shaft 71 and the movable supporting shaft 111 shorter than the roller shaft 70 by moving the movable supporting shaft 111 so as to approach the fixed supporting shaft 71, the detaching of the retard roller 10 can be prevented.

A regulation wall 113, serving as regulation means for regulating the movement of the movable supporting shaft 111, is detachably provided at a position where the fixed supporting shaft 71 and the movable supporting shaft 111 engage with both ends of the roller shaft 70 of the retard roller 10.

Figure 2A:
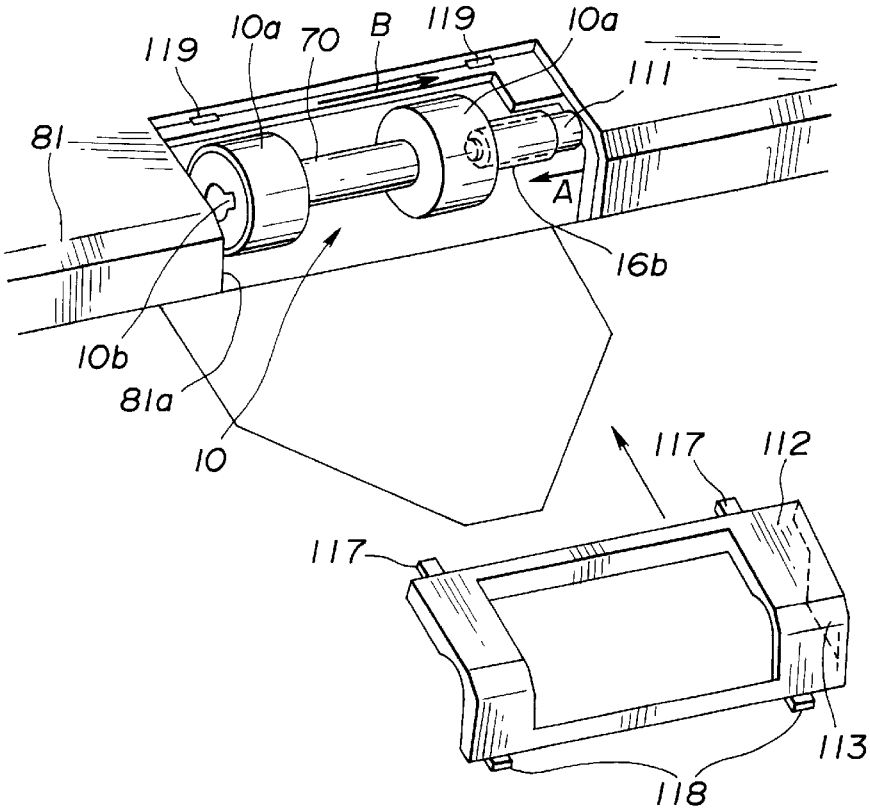
FIGS. 2(*a*) and 2(*b*) illustrate the surrounding structure of the retard roller.
Figure 2B:
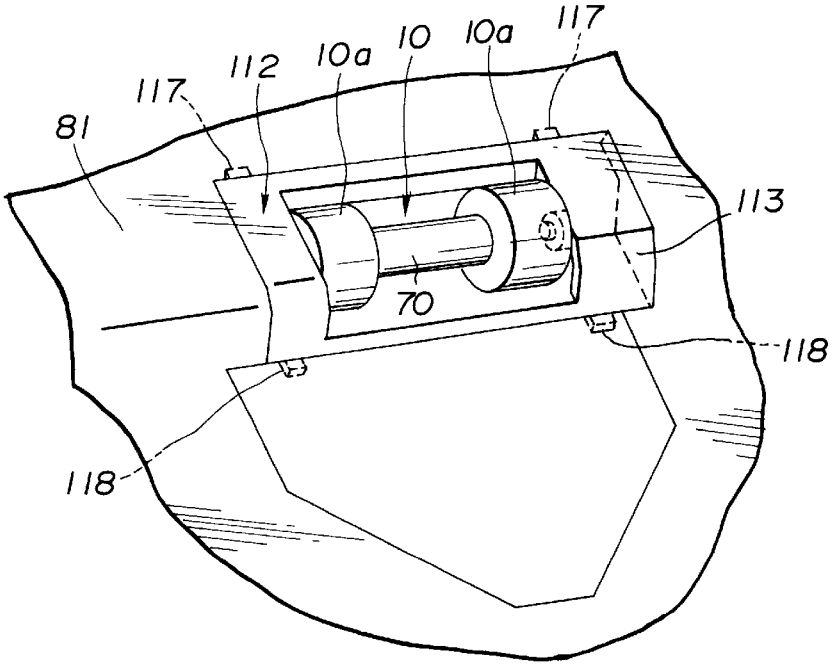

FIGS. 2(*a*) and 2(*b*) are perspective views illustrating the surrounding structure of the detachable retard roller 10.

As described above, the movable supporting shaft 111 is supported on the second slide bearing 16*b* of the supporting lever 16 so as to be movable in the thrust direction, and supports the retard roller 10 by being urged in the direction of an arrow A shown in FIG. 2(*a*) with a relatively weak force.

A retard-roller cover 112 serves as a guide cover for making a portion of a lower guide 81, serving as a guide member for guiding an original, in the vicinity of the retard roller 10, detachable, and blocks an opening 81*a* provided in the lower guide 81 where the retard roller 10 can be accommodated and detached.

When being mounted on the lower guide 81, the retard-roller cover 112 regulates the movement of the movable supporting shaft 111 in the thrust direction indicated by an arrow B in FIG. 2(*a*) so that the retard roller 10 is assuredly held and is prevented from being detached even if a vibration or a shock is applied. That is, instead of elastically holding the movable supporting shaft 111 by a spring or the like, the movable supporting shaft 111 is fixedly held by the regulation wall 113. Hence, an unnecessary force is not applied, and the retard roller 10 is not detached even if vibration or a shock is applied.

Four projections 117, 117 and 118, 118 are provided on the retard-roller cover 112, and are snap-fitted in grooves 119 provided in the lower guide 81.

In the above-described configuration, when exchanging the retard roller 10, the retard-roller cover 112 is first detached from the lower guide 81 by disengaging the engagement of the projections 117 and 118 of the retard-roller cover 112. Then, the retard roller 10 is detached from the fixed supporting shaft 71 present at the left in FIG. 2(*a*) by sliding the retard roller 10 in the direction of the arrow B. Thereafter, the retard roller 10 is detached from the movable supporting shaft 111 present at the right and is taken out. A new retard roller 10 is then mounted according to procedures opposite to the above-described procedures.

By providing a spring having such a small elastic force that no load is provided for the rotation of the retard roller 10 between the movable supporting shaft 111 and the retard roller shaft 70, the operation of detaching the retard roller 10 can be easily performed.

FIG. 3 is a detailed cross-sectional view illustrating the surrounding structure of the above-described lower guide 81.

The lower guide 81 serves as a guide member for forming an original-conveying path. A drawing-roller shaft 82 serves as the shaft of a drawing roller 21. As described above, the spring-anchoring notch 83 can adjust the pressing force with which the pressing lever 18 rotatably supported around the shaft 15 causes the retard roller 10 to be in pressure contact with the feed roller 9. The leading edges of originals mounted on the original-feeding tray 3 contact a contact wall 84.

In FIG. 3, all members except idler roller 31 swing by opening/closing the upper opening/closing guide 6 around the drawing-roller shaft 82. When the upper opening/closing cover 6 is closed, the idler roller 31 is urged by a spring 33 to press a sheet discharging roller 30. When the upper opening/closing cover 6 is opened, the urging force to the idler roller 31 is released, and no pressure is applied to the sheet discharging roller 30.

Returning to FIG. 4, a leaf spring 11 causes the drawing roller 21 for drawing an original separated by the feed roller 9 and the retard roller 10, and an idler roller 22, to be in pressure contact with each other. The leaf spring 11 is fixed on the upper opening/closing guide 6. The idler roller 22 and an idler-roller shaft (not shown) are also fixed on the upper opening/closing guide 6. When the upper opening/closing guide 6 is opened, the feed roller 9 and the retard roller 10, and the drawing roller 21 and the idler roller 22 are released from each other, respectively, so that a jammed original can be easily removed.

A sensor lever 12 detects if originals are mounted on the original-feeding tray 3. The sensor lever 12 is supported on the upper opening/closing guide 6 so as to be swingable between positions to block/open the optical path of a photosensor 20 in accordance with the absence/presence of originals, respectively.

Reference numerals 13 and 13' represent an up-and-down swinging tray for pressing the mounted originals against the pickup roller 8 for each sheet feeding operation. 13' represents the up position and 13 represents the down position.

Reference numeral 14 represents a rotation shaft of the swinging tray 13. The swinging tray 13 is raised and lowered by a lever, a rotating cam and a motor for driving the rotating cam (not shown).

Reference numeral 13 represents the swinging tray at an ordinary lowered position, and reference numeral 13' represents the swinging tray at a raised position. The swinging tray 13 is raised by the spring force of an urging spring (not shown), and is lowered by the above-described cam against the force of the urging spring. The thickness of the mounted original bundle is thereby absorbed.

Reference numeral 23 represents an original-feeding roller for allowing running reading of an original at an original-reading portion 29. Reference numeral 24 represents an idler roller in pressure contact with the original-feeding roller 23. The idler roller 24 is urged against the original-feeding roller 23 by a spring 25.

The spring 25 is rotatably supported around a fulcrum 27 of the frame, and is bent from the position indicated by a broken line to the position indicated by a solid line by a projection 26 present at the distal end of the upper opening/closing guide 6, to urge the idler roller 24 against the original-feeding roller 23.

When an original is jammed, the upper opening/closing guide 6 is opened upward, and the spring 25 is thereby moved to the position indicated by the broken line. The urging force of the idler roller 24 thereby disappears, and the jammed original can be easily removed.

Reference numeral 28 represents a film comprising a transparent polyester sheet or the like. A gap of about 0.9 mm for passing the original is provided between the film 28 and a white guide member 38. While the original passes through the gap, the image of the original is read by the original-reading portion 29 via the transparent film 28.

There are also shown a sheet discharging roller 30 and an idler roller 31 facing it. The idler roller 31 is urged against the sheet discharging roller 30 by a spring 33 fixed on the white guide member 38.

The white guide member 38 is rotatably supported on the shaft of the original-feeding roller 23, and is positioned by being pressed downward by the upper opening/closing guide 6. That is, when the upper opening/closing guide 6 is released, the white guide member 38 swings upward. As a result, the force to urge the idler roller 31 against the sheet discharging roller 30 is released. Jam removing processing is thereby facilitated.

As described above, it can be understood that, by releasing the upper opening/closing guide 6 upward, the conveying nips of all of the feed roller 9, the drawing roller 21, the original-feeding roller 23 and the sheet discharging roller 30 are simultaneously released.

An electrostatic-charge removing needle 32 prevents a discharged original from being charged and adhering to the back of the discharged-sheet tray 39 or the original-feeding tray 3, thereby causing, for example, a jam of mounted originals.

The electrostatic-charge removing needle 32 also has the role of curl pressing by preventing the trailing edge of the discharged original from rising due to upper curl and thereby hindering an operation of discharging the next original. Accordingly, the charge removing needle 32 is longer than an ordinary charge removing needle.

Reference numeral 34 represents a leg for mounting and which protrudes from the original-feeding device 1. The leg 34 is rotatable around a shaft 35 fixed to the frame of the original-feeding device 1, so that the original-feeding device 1 can be opened from the main body 2 of the flat-bed scanner present at a lower position. Reference numeral 36 represents an electronic-circuit board for controlling the original-feeding device 1.

Projection 26 is urged against leaf spring 37 causing it to press a switch (not shown) mounted on the electronic-circuit board 36. The projection 26 is provided on the upper opening/closing guide 6. The opened state of the upper opening/closing guide 6 is thereby detected, and the operation of the original-feeding device 1 is stopped for the purpose of safety.

An original-end detection sensor 41 is provided in order to detect the leading edge and the trailing edge of the original for control of movement of the original.

The platen glass 40 is provided at an upper portion of the main body 2 of the scanner. The image of the original mounted on the original-mounting glass 40 is sent to an imaging lens 46 via a first mirror 44, and second mirrors 45 moving at a speed half the speed of the first mirror 44, and is focused by the imaging lens 46 onto a line sensor 47 comprising a CCD (charge-coupled device), which converts optical-image information into an electrical signal. According to the movement of the first mirror 44 and the second mirrors 45 with the speed ratio of 1:½, the optical distance between the original on the platen glass 40 and the line sensor 47 is maintained constant.

Figure 5:
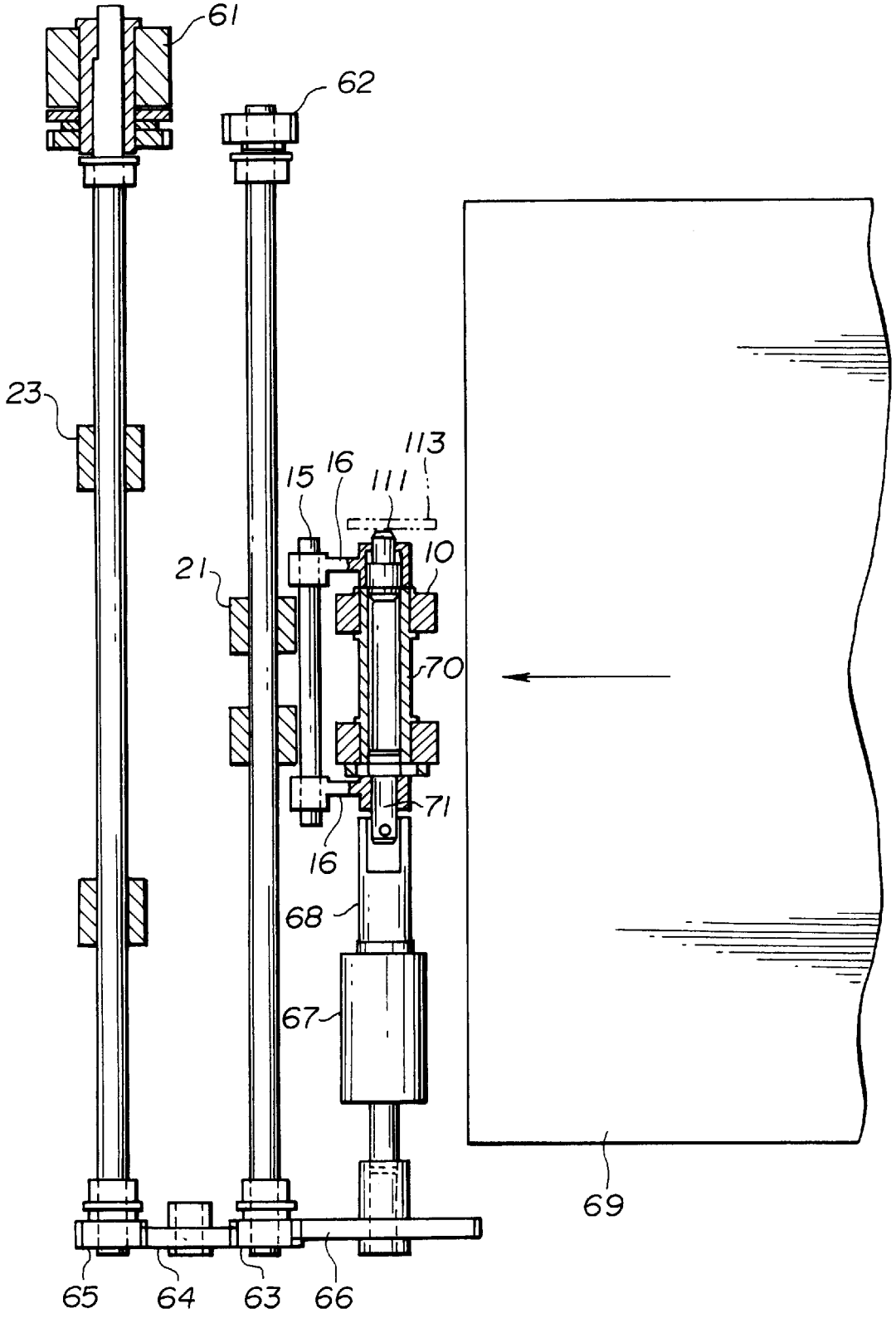
FIG. 5 is a diagram illustrating development along a conveying path.
Figure 6:
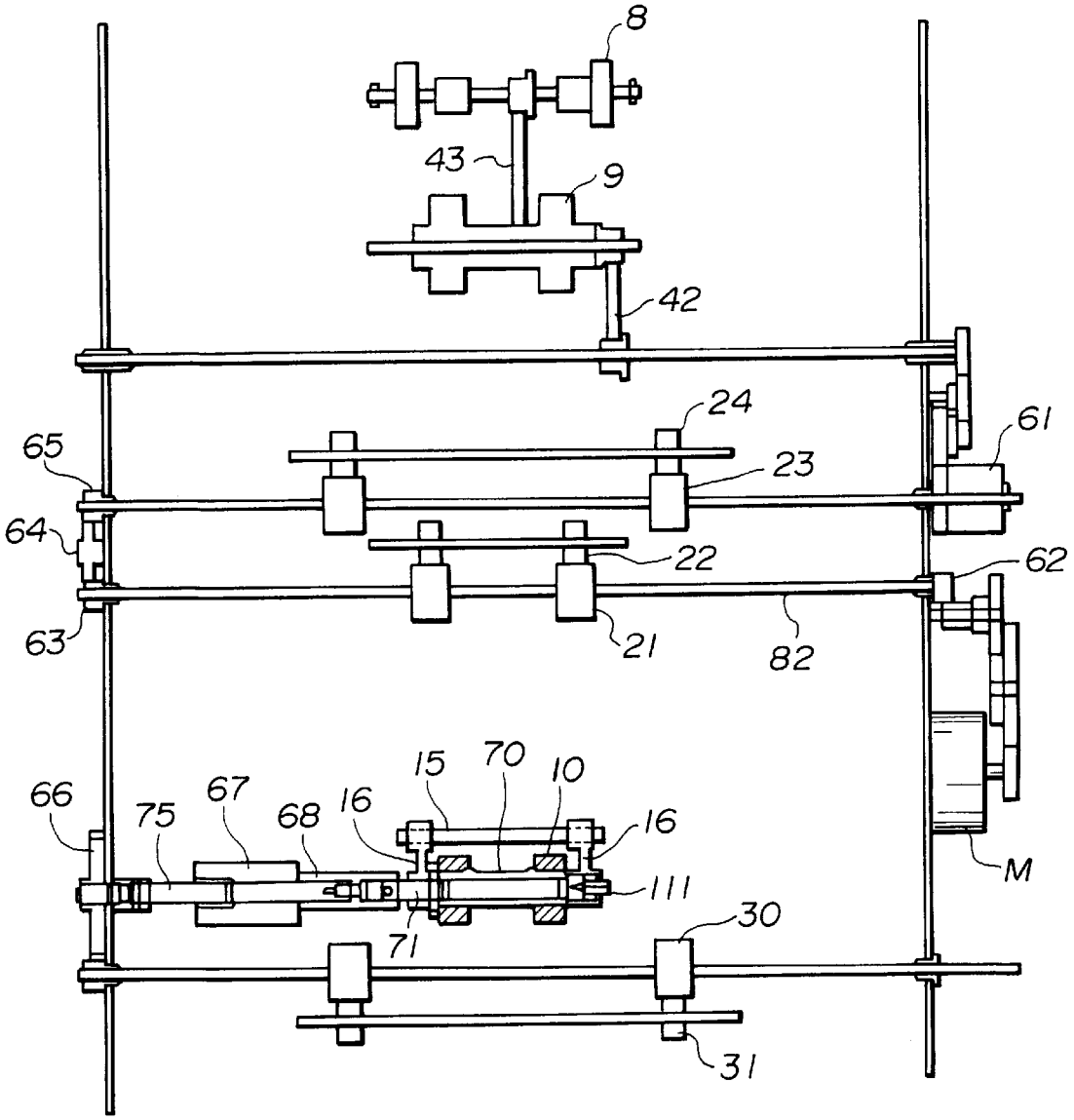
FIG. 6 is a schematic diagram illustrating a driving system of a conveying unit.

FIG. 5 is a diagram illustrating conveyance along an original-conveying path. FIG. 6 is a diagram illustrating a driving system. Since the retard roller 10 has already been described, a description thereof will be omitted.

In FIGS. 5 and 6, a gear 62 transmits a driving force from a motor M, such as a pulse motor or the like, and rotates the drawing roller 21. The driving force is transmitted from a gear 63 provided at the opposite side of the shaft 82 to a gear 65 via a gear 64 to rotate the original-feeding roller 23. The driving force is also transmitted to a gear 66 to rotate the retard roller 10.

An electromagnetic clutch 61 selectively drives the driving shaft 7 shown in FIG. 4, which drives the feed roller 9 and the pickup roller 8 using belts 42 and 43.

According to the above-described configuration, when the electromagnetic clutch 61 is turned on, as shown in FIG. 6, the feed roller 9 and the pickup roller 10 are driven in the sheet feeding direction to feed the original. When the electromagnetic clutch 61 is then turned off, the driving shaft 7 is freed, and the feed roller 9 is thereby freed to be driven in a direction opposite to the sheet feeding direction by the retard roller 10 in pressure contact therewith. It is thereby possible to discharge the original entering the nip between the feed roller 9 and the retard roller 10 toward the original-feeding tray 3. Since this operation is performed at every sheet feeding operation, it is possible to prevent a jam or feeding of a plurality of originals caused by a large amount of originals entering the separation nip.

By performing this operation of discharging originals from the separation nip before the first original-feeding operation, originals can be returned to an oridinary position even if the user forcedly inserts the bundle of originals into the separation nip. Hence, a jam or feeding of a plurality of originals can be prevented.

The pickup roller 8 is driven via a one-way clutch to which a driving force is transmitted only when the pickup roller 8 rotates in the sheet feeding direction. Since a one-way clutch, serving as a brake, for hindering the rotation when the pickup roller 8 is driven in a direction opposite to the sheet feeding direction, the pickup roller 8 stops or rotates in the sheet feeding direction, but does not rotate in the reverse direction.

Figure 7A:
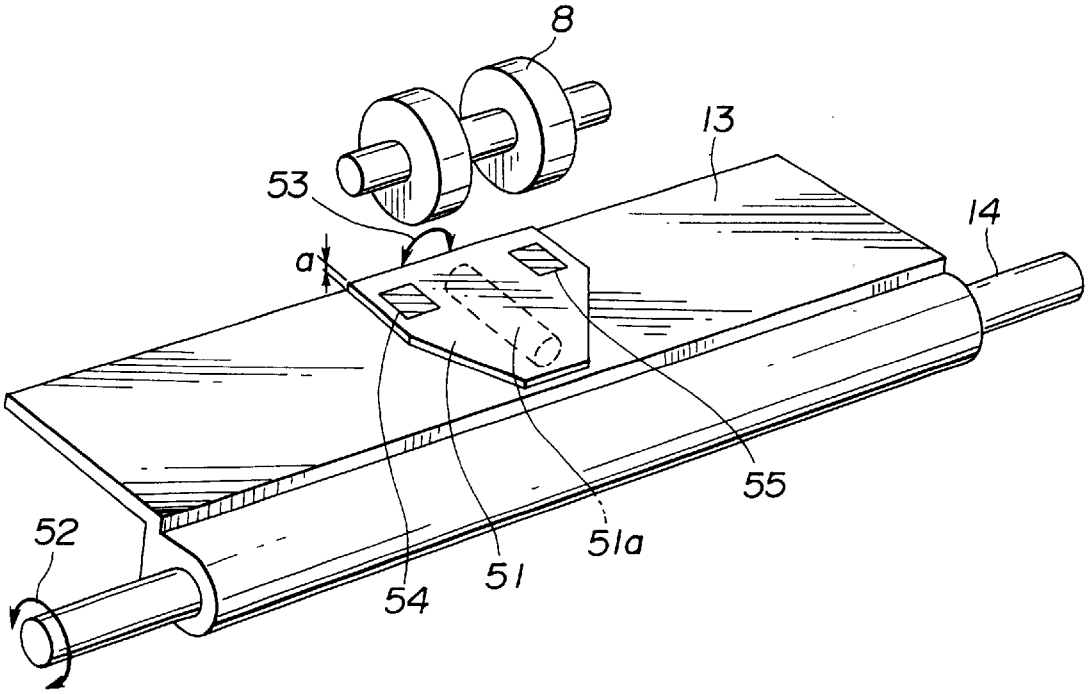
FIG. 7(*a*) is a diagram illustrating the structure of an up-and-down swinging tray.
Figure 7B:
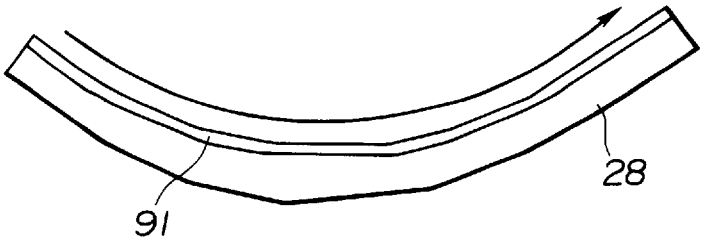

FIG. 7(*a*) is a diagram illustrating the structure of the up-and-down swinging tray 13.

The up-and-down swinging tray 13 swings in the directions of a two-headed arrow 52 around the rotation shaft 14 to assist the original-feeding operation by bringing the original into contact with the pickup roller 8. An equalizing plate 51 is mounted on the up-and-down swinging tray 13 so as to swing in the directions of a two-headed arrow 53 around a swinging shaft 51*a* at the center so that a uniform force is applied to contact portions 54 and 55 with the pickup roller 8.

In order to secure the equalizing operation of the equalizing plate 51, a predetermined step "a" is provided between the up-and-down swinging tray 13 and the equalizing tray 51. The step "a" is set to about 1 mm.

FIG. 7(*b*) is an enlarged view illustrating the vicinity of the film 28. Film 28 comprises a polyester sheet or the like.

It has been confirmed through experiments that the surface area of the film 28 where the original passes is not damaged even after the passage of a hundred thousand A4-size originals if a scratch-resistant coating having a pencil hardness of at least 2H is provided on the film. That is, by providing a scratch-resistant coating 91 having a pencil hardness of at least 2H on the original-conveying surface of the film 28, it is possible to prevent the occurrence of various problems, such as degradation in the read image due to a decrease in the transmittance caused by damage produced during the passage of a hundred thousand or more originals, a failure in the passage of originals due to an increase in the surface roughness of the surface where originals pass, and the like, to provide excellent images, and to perform secure feeding of originals.

In the present embodiment, in order to prevent charge accumulation on the film 28, a material incorporating an antistatic agent is used for the film 28. Thus, adherence of the original to the film 28 due to static electricity is prevented.

Figure 8A:
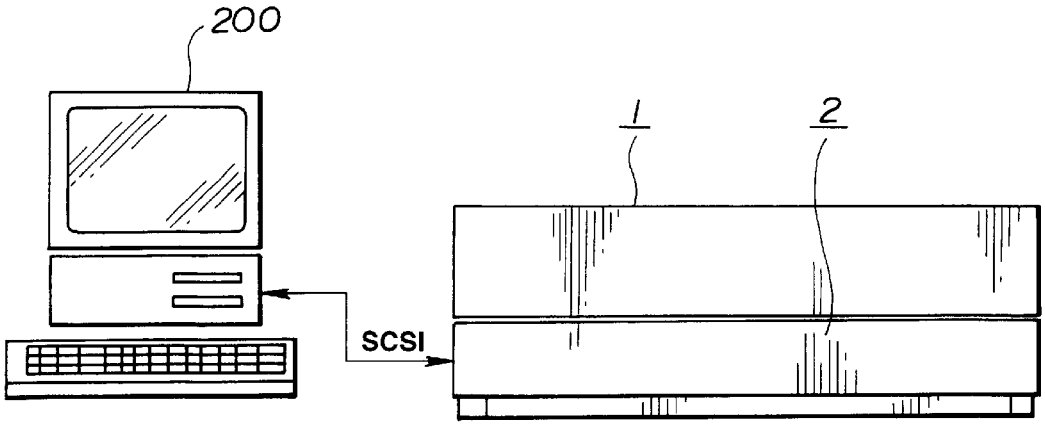
FIG. 8(*a*) is a diagram illustrating the configuration of the system of the original-reading device.
Figure 8B:
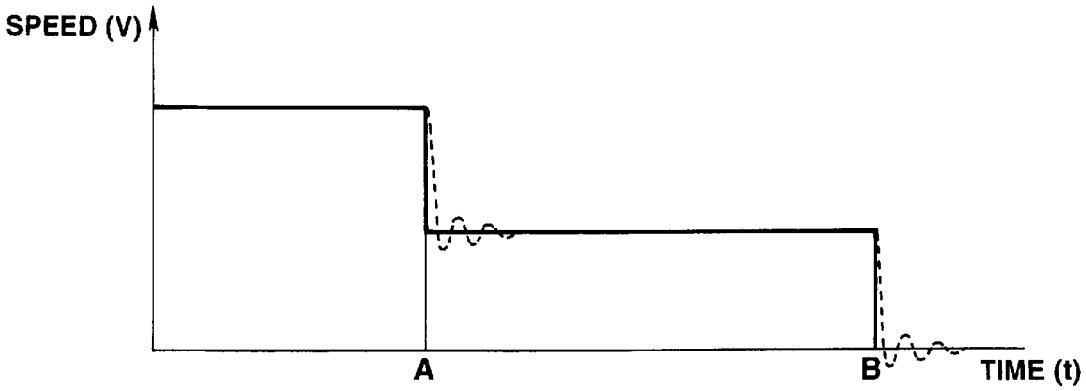

FIG. 8(*a*) is a diagram illustrating the configuration of the system of the original-reading device.

When transferring image data read by the main body 2 of the scanner to a host computer 200, the host computer 200 cannot, in some cases, process the image data transmitted from the main body 2 of the scanner, depending on the memory capacity or the processing speed. In order to deal with such a problem, the so-called start-stop procedure, in which the reading operation of the main body 2 of the scanner is temporarily stopped, is performed.

At that time, in a device using a line sensor for a reading unit, since image processing becomes very difficult if the storage time is gradually changed, it is impossible to gradually change the speed during reading. Hence, instant stop and instant start are required. However, since the reading speed increases as the processing speed of the personal computer increases, it becomes difficult to maintain the continuity of the image during start-stop reading and to prevent loss of synchronism of the motor. Hence, in the original-feeding device 1 and the main body 2 of the scanner of the present embodiment, a sequence of full speed →½→ stop, i.e., a sequence in which a half-speed period is provided instead of instantaneously stopping the reading operation, is adopted.

Such an operation of changing the speed stepwise during an original-reading operation is termed step-down.

FIG. 8(*b*) is a diagram briefly illustrating start-stop and step-down during a reading operation.

In FIG. 8(*b*), the ordinate represents the feeding speed of the original-feeding roller 23 or the first mirror 44, and the abscissa represents time. While an image is read at a certain speed, if it appears that all of image data cannot be processed due to the memory capacity, the communication speed or the like, the reading speed at this time A is halved. That is, if the remaining capacity of the buffer memory becomes insufficient, the reading speed is halved. Such an operation is termed step-down. Thereafter, the reading operation is continued at the half speed. When the computer 200 cannot process all of the image data, i.e., when the remaining capacity of the buffer memory becomes zero, the main body 2 of the scanner repeats an operation of interrupting the reading operation until the data processing of the computer 200 is completed and resuming the reading operation in response to a request from the computer 200. This is represented by point B in FIG. 8(*b*). Such an operation is termed start-stop. In FIG. 8(*b*), the dashedd lines represent oscillation. As can be seen, after step down at point A reading is continued even during oscillation. After reading is stopped at point B, oscillation does not occur.

Figure 9:
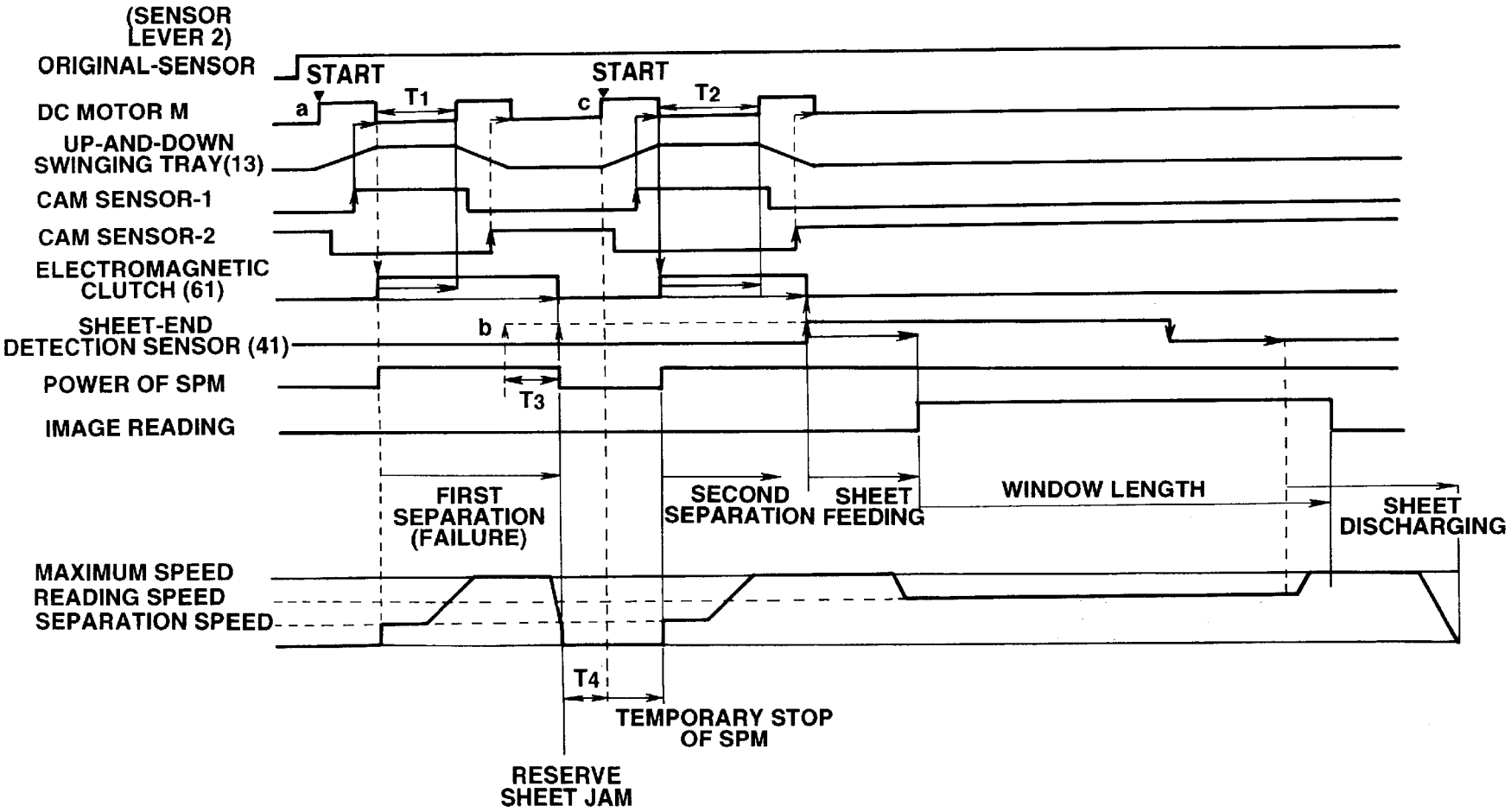
FIG. 9 is a diagram illustrating a retrying sequence during a jam.

FIG. 9 is a diagram illustrating a retrying sequence during a jam used in the original-reading device. The retrying sequence is a sequence in which, when the pickup roller 8 slips, the state is not instantaneously determined as a jam, and the sheet feeding operation by the pickup roller 8 is repeated a plurality of times. The state is determined as a jam only when the sheet is not fed after repeating the operation a predetermined number of times. In the original-feeding device 1 of the present embodiment, the sequence comprises the following steps.

That is, the up-and-down swinging tray 13 is raised in response to a sheet-feeding resuming signal (portion "a" in FIG. 9). After a predetermined time period, the electromagnetic clutch 61 is turned on. After the up-and-down swinging tray 13 has been raised for a predetermined time period T1, the up-and-down swinging tray 13 is lowered. When the leading edge of the original has been detected, the electromagnetic clutch 61 is turned off after a predetermined time period or instantaneously. Originally, the conveyance of the original is started when the electromagnetic clutch 61 is turned on, and the original-end detection sensor 41 detects the leading edge of the original after a predetermined time period (portion b in FIG. 9).

However, when the pickup roller 8 or the feed roller 9 slips, the original is not fed by a predetermined amount, and the original does not pass through the original-end detection sensor 41 at a predetermined timing. When the original does not pass through the original-end detection sensor 41 even after a predetermined time period T3, the motor M is stopped, to temporarily interrupt the sheet feeding operation for a predetermined time period T4, and retrying is performed by repeating the sheet feeding sequence from the raise of the up-and-down swinging tray 13 (portion c in FIG. 9). At that time, by making the time period T2 of the second rise of the up-and-down swinging tray 13 longer than T1, a secure sheet feeding operation can be performed.

Figure 10:
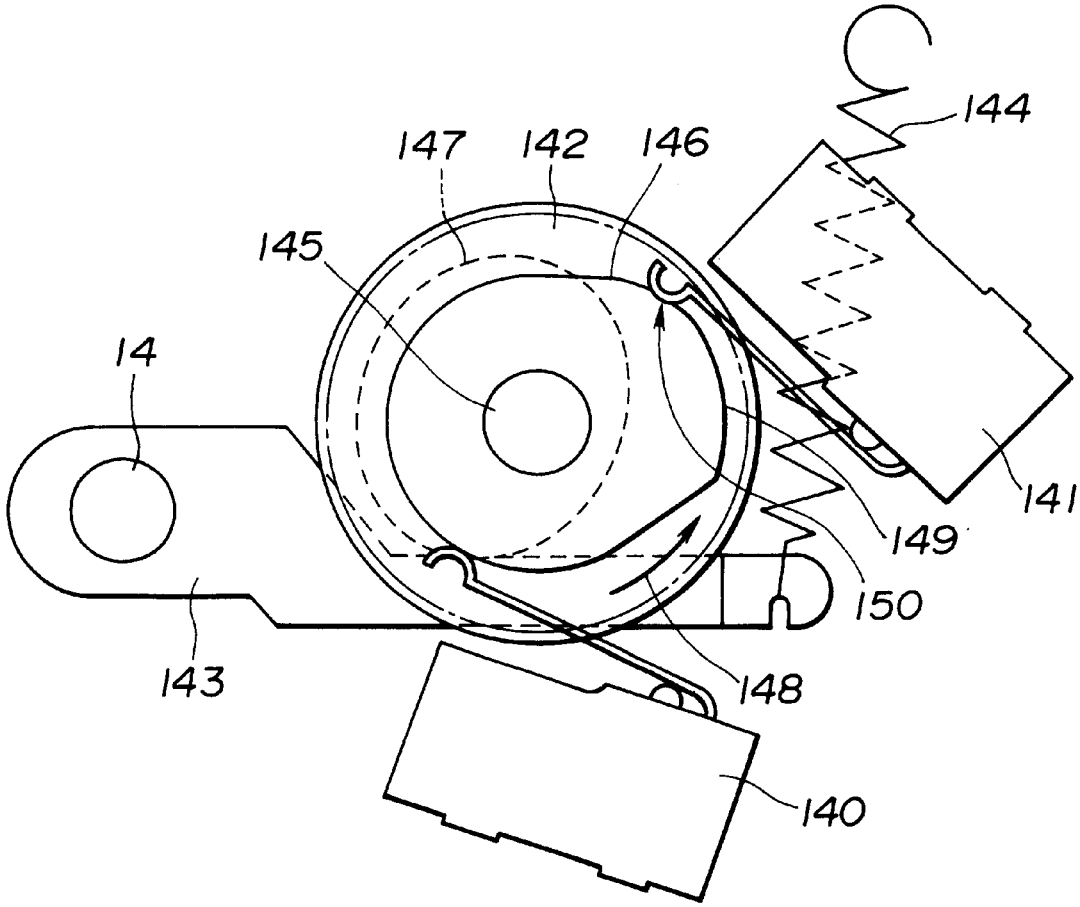
FIG. 10 is a diagram illustrating the mechanism of a rotating cam.

FIG. 10 is a diagram illustrating the structure of a rotating cam 142.

A first cam sensor 140 and a second cam sensor 141 are turned on/off by a first cam 146 of the rotating cam 142 rotating around a shaft 145 fixed on the frame of the original-feeding device 1. A lever 143 fixed to a rotation shaft is always urged upward by an urging spring 144, and is swung by a second cam 147 of the rotating cam 142 around the rotation shaft 14 of the swinging tray 13, to raise or lower the up-and-down swinging tray 13 pivoted on the shaft 14.

That is, the rotating cam 142 simultaneously performs the two operations of turning on/off the cam sensors and raising/lowering the up-and-down swinging tray 13 with the different cams 146 and 147, respectively.

An arrow 148 indicates the direction of rotation of the rotating cam 142. The rotating cam 142 engages with a worm gear mounted on a DC motor (not shown) via a wheel gear integrated with the rotating cam 142.

Reference numeral 149 represents a vertex of the cam where the first cam sensor 140 and the second cam sensor 141 must stop. First, the cam is rotated in the direction of the arrow 148 by turning on the DC motor. The cam sensor which has been turned on is thereby turned off, the other cam sensor which has been turned off is turned on. The DC motor is turned off so that the contact point between the lever of the cam sensor and the cam 146 stops at the position of the vertex 149. Thus, the cam 142 can be stopped at about every half rotation. As a result, the up-and-down swinging tray 13 fixed on the shaft 14 can be stopped at a raised position and a lowered position.

Reference numeral 150 represents a cam surface connecting vertices of the cam. The cam surface 150 is smoother than other portion facing it. The cam surface 150 is provided in order to prevent the lever of the cam sensor 140 from contacting the counter to damage the lever when the cam 142 rotates in the direction of the arrow 148.

The time period from the stop of the DC motor to the stop of the cam 142 differs, for example, depending on the lot of the device. Hence, the characteristics of the DC motor are learned by rotating the cam by at least one revolution when electric power is supplied. The DC motor is turned off by obtaining the timing where the cam vertex 149 equals the contact point with the cam sensor based on the data of the DC motor.

Figure 11:
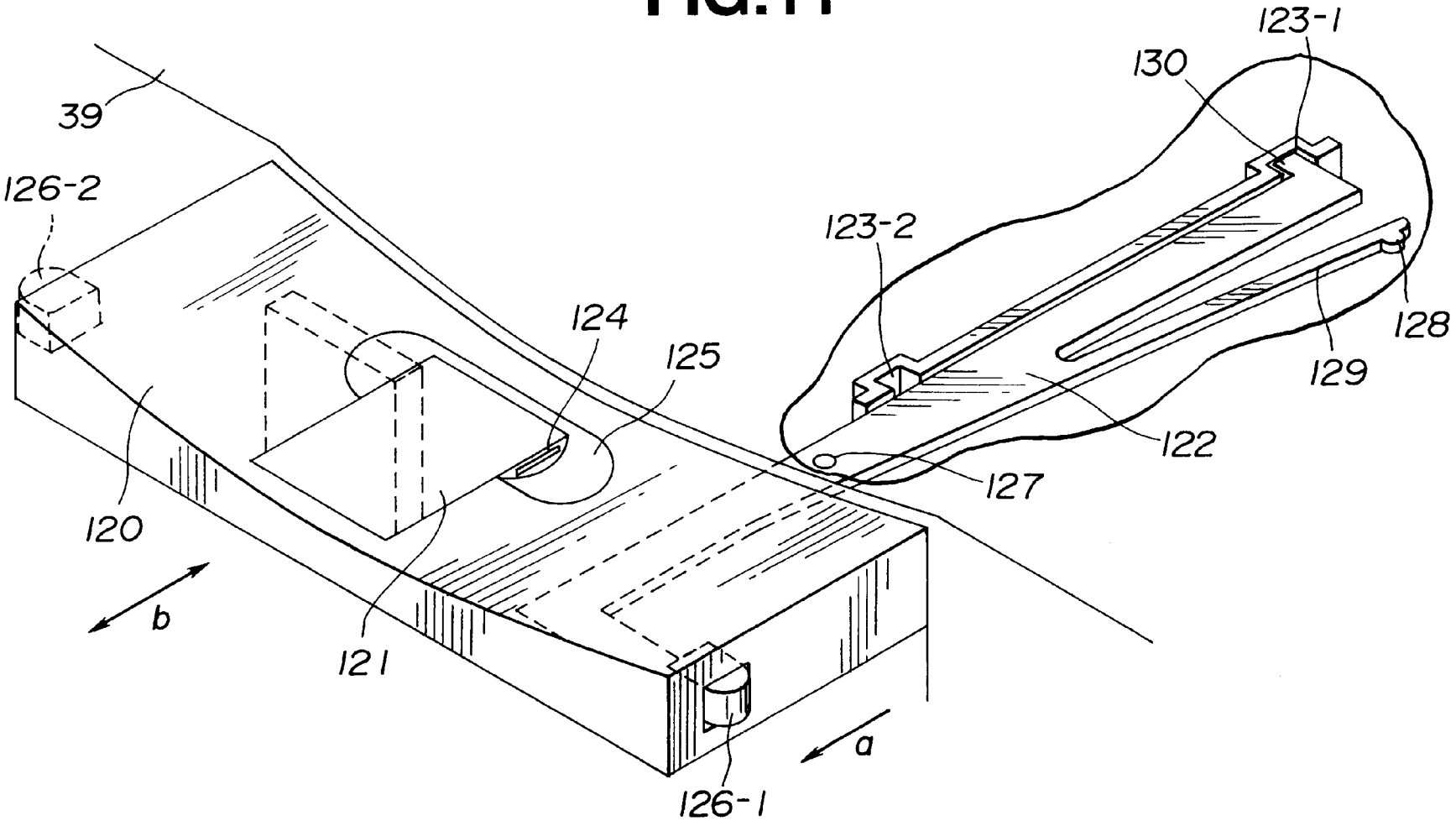
FIG. 11 is a perspective view illustrating a stopper portion.
Figure 12A:
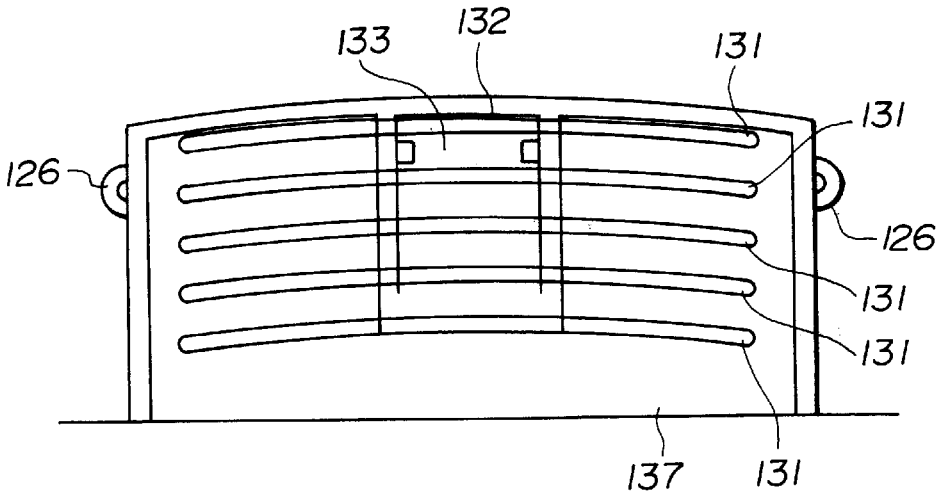
FIG. 12(*a*) is a bottom view of a stopper.
Figure 12B:
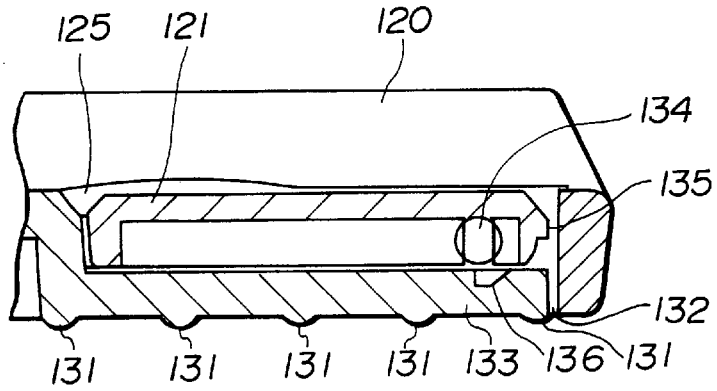
Figure 12C:
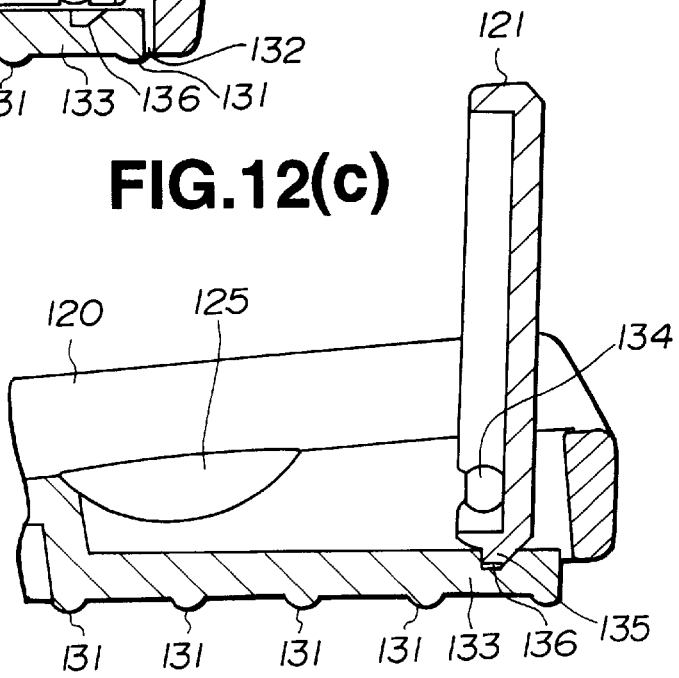
Figure 13A:
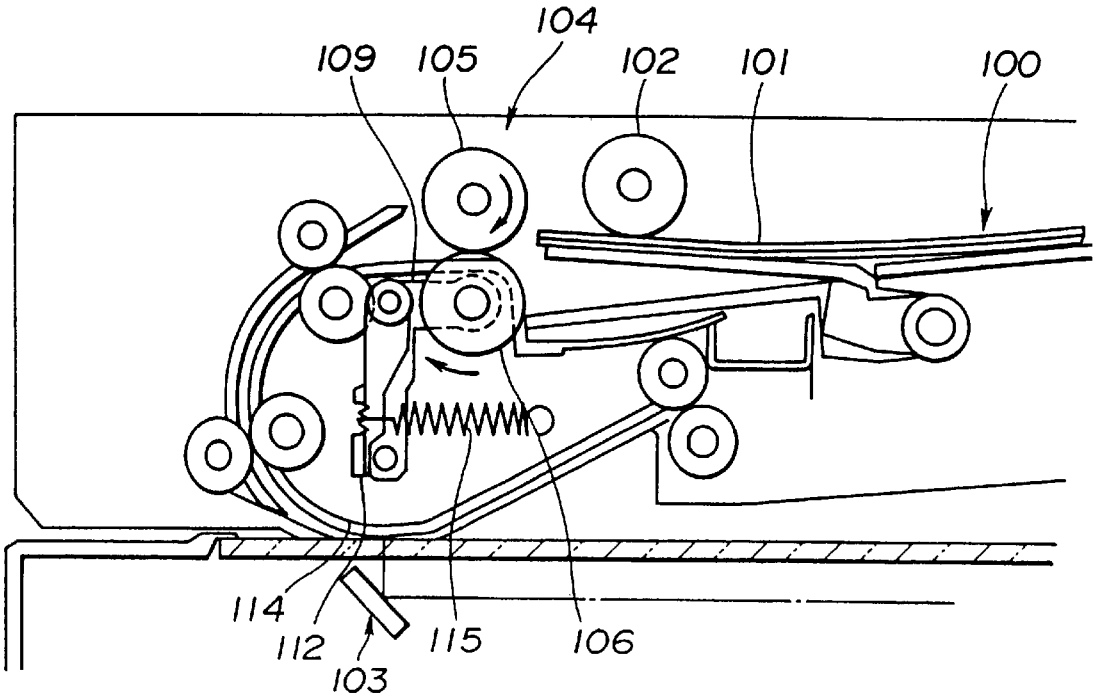
FIG.13(a) PRIOR ART
FIG. 13(*a*) is a diagram illustrating the configuration of a principal portion of a conventional original-reading device.
Figure 13B:
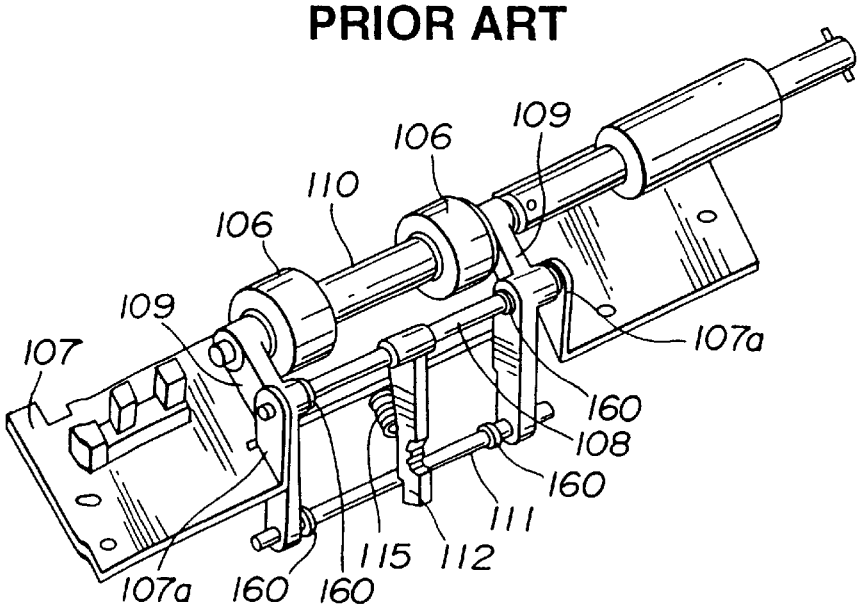
FIG.13(b) PRIOR ART
Figure 14:
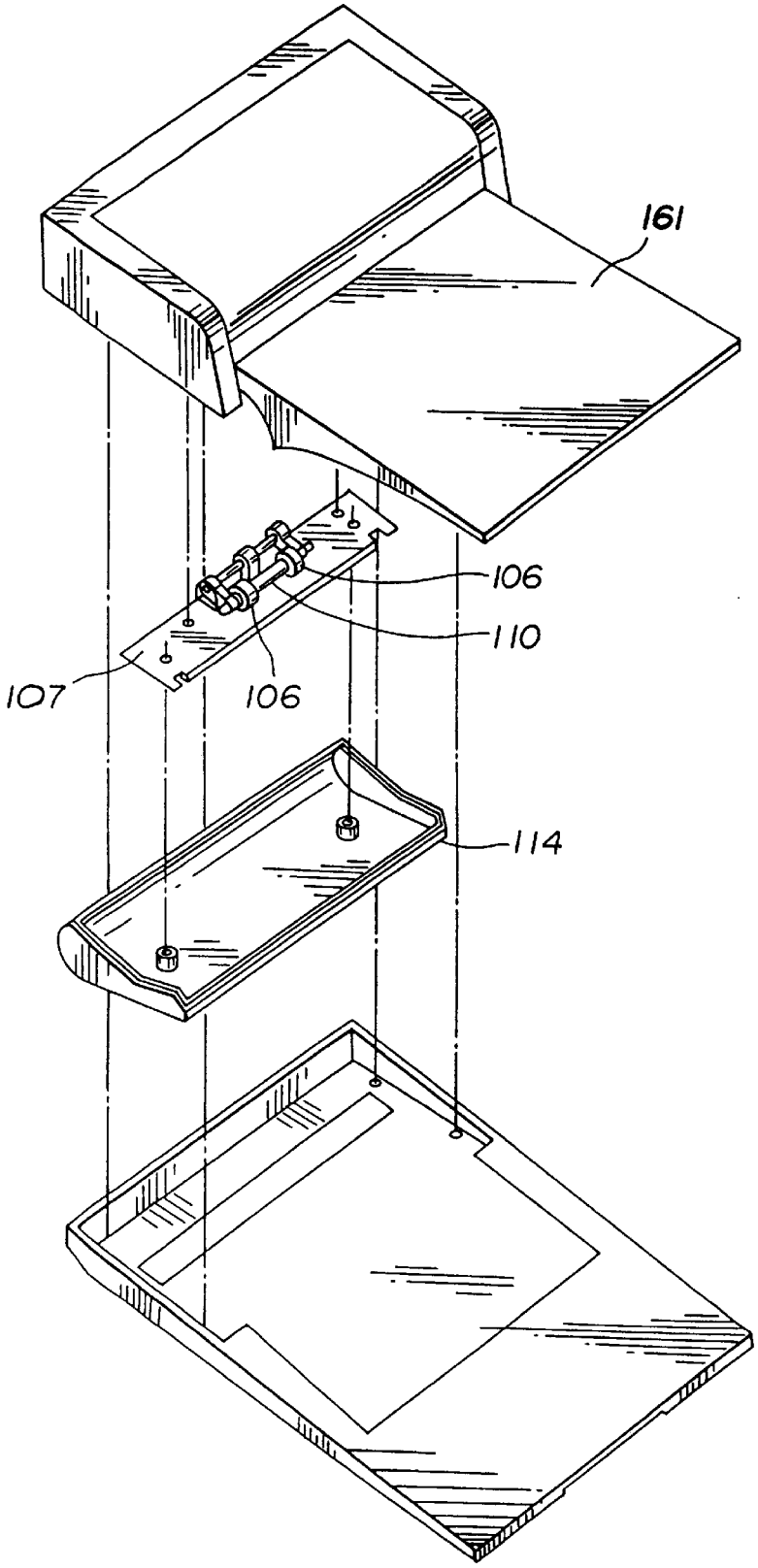
FIG.14 PRIOR ART
FIG. 14 is an exploded perspective view of the conventional original-reading device.
Figure 15:
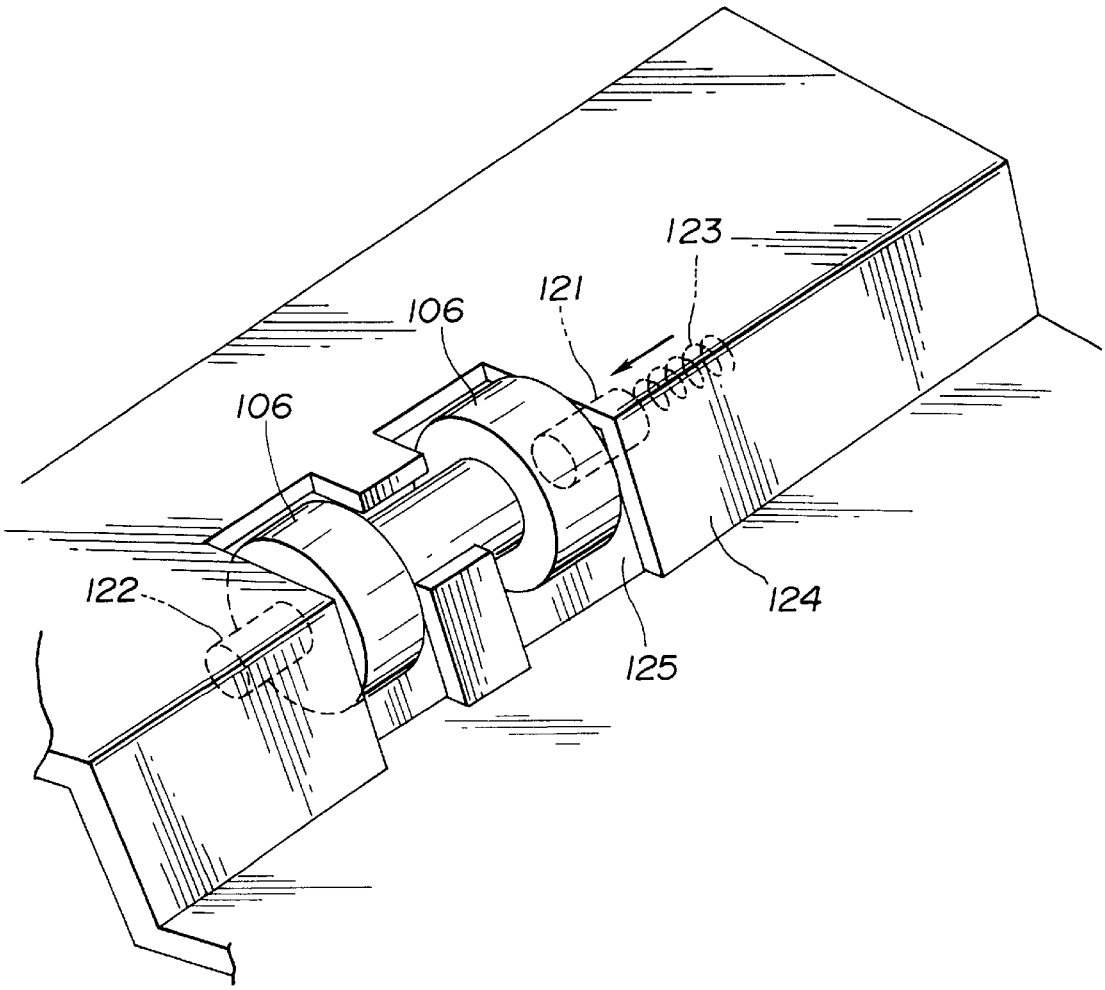
FIG.15 PRIOR ART
FIG. 15 is a diagram illustrating the configuration of a conventional structure for supporting a retard roller.

FIGS. 11 through 12(*c*) are diagrams illustrating the movement of a stopper 120 for preventing hanging of the original mounted on the discharged-sheet tray 39.

The stopper 120 is moved between a pushed position and a drawn position in the directions of a two-headed arrow b in accordance with the size of the original.

Usually, a contact portion 128 of a spring 129 formed integrally with a stopper lever 122 incorporated within the stopper 120 contacts a wall (not shown) formed in the stopper 120, and a projection 130 is urged and fitted in a first groove 123-1.

The stopper 120 is moved from the pushed position to the drawn position in the following manner. That is, by rotating the stopper lever 122 around a fulcrum 127 by depressing lever buttons 126-1 and 126-2, the projection 130 is released from the first groove 123-1. Then, the projection 130 is fitted in another groove 123-2 by moving the stopper lever 122 in the direction of an arrow "a". The stopper lever 122 is moved from the drawn position to the pushed position by pushing the stopper 120 while depressing the lever button 126-1.

The projection 130 and the grooves 123-1 and 123-2 are present on circles around the fulcrum 127. By minimizing the gap between the projection 130 and the grooves 123-1 and 123-2, the backlash in a direction orthogonal to the direction of drawing the stopper 120 is reduced.

Although not illustrated in FIG. 11, the same configuration as the configuration comprising the stopper lever 122, the grooves 123-1 and 123-2, the stopper button 126-1, the fulcrum 127, the contact portion 128, the spring 129 and the projection 130 is provided at the opposite side of the stopper 120. The above-described function is satisfied by simultaneously depressing the lever buttons 126-1 and 126-2.

A stopper tab 121 operates as a contact stopper for preventing the original from dropping from the discharged-sheet tray 39. Either the position indicated by solid lines when the stopper tab 121 is not used or the position indicated by broken lines when the stopper tab 121 is used can be selected for the stopper tab 121.

The stopper tab 121 can be easily placed at the position of use by inserting a finger into a groove 125 and raising a projection 124 of the stopper tab 121 using a person's finger or nail.

FIG. 12(*a*) is a diagram illustrating the stopper 120 as seen from below.

A cover 137 is provided on the stopper 120, and finger-anchoring projections 131 are provided on the cover 137, as shown in FIG. 12(*a*), in order to prevent accidental slip of the user's hand when the user opens/closes the original-feeding device 1 by holding the stopper 120.

FIGS. 12(*b*) and 12(*c*) are cross-sectional views obtained by cutting a central portion of the stopper tab 121.

The stopper tab 121 rotates around a rotation shaft 134, and operates as a cantilever due to a slit 132 cut in the stopper 120 to bend a spring 133 downward. As shown in FIG. 12(*c*), the stopper tab 121 is locked so as to operate as the contact stopper at the position indicated by the dashed lines shown in FIG. 11 by fitting a projection 135 of the stopper tab 121 into a recess 136 of the spring 133.

Although, in the foregoing embodiment, a description has been provided illustrating the case in which only one of the supporting shafts, serving as a pair of supporting members for supporting the retard roller 10, serving as the main body or the roller, is movable, both of the supporting members may be movable.

The present invention is not limited to an original-reading device, but may, of course, be applied to a retard roller of a separation conveying unit of an image recording apparatus, such as a copier, a printer or the like, in which a plurality of sheets of a sheet material are individually separated, and each of the separated sheets is fed to a recording portion where information is recorded on the fed sheet.

As described above, according to the present invention, by making the main body of a roller detachable relative to a pair of supporting members in the axial direction, and making at least one of the supporting members movable in the axial direction, the main body of the roller can be easily detached and mounted.

Furthermore, since the supporting members are held by regulation means instead of being elastically held by a spring or the like, unnecessary force is not applied, and the main body of the roller does not detach due to a vibration or a shock.

By transmitting a driving force from a driving source while fixing one of the supporting members, the main body of the roller can be easily exchanged without decomposing the driving-force transmission unit.

In addition, even in a complicated supporting structure in which a pair of supporting members are supported at swinging ends of a pair of supporting levers swingably supported ported on a pivoting shaft, the main body of the roller can be easily detached without decomposing the supporting levers.

By providing a regulation wall on a guide cover covering an opening provided in a guide member for guiding a sheet material, regulation means can be mounted/released only by detaching the guide cover.

By performing snap engagement between a guide cover and a guide member, the guide cover can be easily mounted and detached.

By configuring supporting members by a pair of supporting shafts inserted in bearing members, and by providing engaging holes where the supporting shafts can be inserted/detached at end portions of the main body of the roller, the main body of the roller can be easily mounted/detached only by inserting/drawing the supporting shafts in/from the engaging holes provided at the end portions of the main body of the roller.

If the roller supporting device of the present invention is used as a supporting device of a rotating member for separation constituting separation conveying means of a sheet-material feeding device for individually separating sheets of a sheet material and conveying each of the separated sheets, the maintainability of the device is improved.

By applying the sheet-material feeding device of the present invention to an original-reading apparatus or an image recording apparatus, the user can easily exchange the separating rotating member, and the maintainability of the device is improved. Accordingly, even if a rotating member for separation is used for a maintenance free product, the rotating member for separation can be easily exchanged, and the life of the entire device is not determined by the life of the rotating member for separation.

The individual components shown in outline in the drawings are all well known in the roller supporting art and sheet feeding device arts and their specific construction and operation are not critical to the operation or the best mode for carrying out the invention.

While the present invention has been described with respect to what is presently considered to be the preferred embodiment, it is to be understood that the invention is not limited to the disclosed embodiment. To the contrary, the present invention is intended to cover various modifications and equivalent arrangements included within the spirit and scope of the appended claims.

What is claimed is:

1. A roller supporting device for supporting a roller having a shaft portion with two ends and a roller portion on a main body of said device, said device comprising:

a pair of supporting members for supporting the roller by each engaging with a respective end of the shaft portion, at least one of said pair of supporting members being a movable supporting member movable axially along the shaft portion so that the roller can be detached by moving said movable supporting member in a separating direction to separate it from the shaft portion; and regulation means for regulating the movement of said movable supporting member in the separating direction by abutting against said movable supporting member in a direction opposite to the separating direction at a regulating position, when said movable supporting member engages with the shaft portion, and said regulation means being movable in a direction non-parallel to the separating direction thereby moving between the regulating position and a non-regulating position in which said movable supporting member can be disengaged from the shaft portion.

2. A device according to claim 1, wherein the shaft portion of the roller is provided with engaging holes, and wherein said pair of supporting members support the roller by engaging with the engaging holes.

3. A device according to claim 1 or 2, wherein the roller is rotatably supported by said pair of supporting members, wherein said pair of supporting members are adapted to be rotatably supported on bearings provided in the main body of said device, and wherein said movable supporting member is supported on one of said bearings so as to be movable in the axial direction.

4. A sheet feeding device having conveying rotation means rotating in a sheet feeding direction, and reverse-rotation separation means, rotating in a direction opposite to the sheet feeding direction, for individually separating sheets between the conveying rotation means and the reverse-rotation separation means and for feeding each of the separated sheets, said device comprising:

a pair of supporting members for supporting the reverse-rotation separation means by engaging with both ends of a shaft portion thereof, said pair of supporting members provided at a main body of said sheet feeding device, at least one of said pair of supporting members being a movable supporting member movable axially along the shaft portion so that the reverse-rotation separation means is detachable when said movable supporting member is moved in a separating direction to separate it from the shaft portion; and regulation means for regulating the movement of said movable supporting member in the separating direction by abutting against said movable supporting member in a direction opposite to the separating direction at a regulating position, when said movable supporting member engages with the shaft portion, and said regulation means being movable in a direction non-parallel to the separating direction thereby moving between the regulating position and a non-regulating position in which said movable supporting member can be disengaged from the shaft portion.

5. A device according to claim 4, further comprising:

an opening adapted to receive/detach the reverse-rotation separation means into/from a guide unit, provided in the main body of said device, for guiding the sheets; and a detachable cover for blocking said opening, wherein said regulation means is provided on said cover.

6. A device according to claim 5, wherein said cover is mounted to the main body of said device by snap enagement with the main body of said device.

7. A device according to claim 5, wherein said cover cooperates with the guide unit for guiding the sheets.

8. A device according to claim 4, wherein said reverse-rotation separation means comprises a shaft portion having engaging holes formed in the axial direction of said shaft portion, and a roller portion provided on the shaft portion, and wherein said pair of supprting members support the reverse-rotation separation means by enganging with the engaging holes.

9. A device according to claim 4, wherein said pair of supporting members are adapted to be rotatably supported on the bearings provided in a lever member swingably supported on the main body of said device, wherein the at least one movable supporting member is supported on one of the bearings so as to be movable in the axial direction, further comprising:

connection means for connecting the other supporting member and the reverse-rotation separation means in a direction of rotation; and drive transmission means for transmitting a drive from a driving source to the other supporting member.

10. A device according to claim 9, wherein said drive transmission means comprises a joint member for allowing drive transmission even if said lever member swings, and a torque limiter for transmitting a predetermined torque.

11. A device according to claim 9, further comprising urging means for rotatably urging said lever member in a direction bringing the reverse-rotation separation means into pressure contact with the conveying rotation means.

12. A sheet processing device having conveying rotation means rotating in a sheet feeding direction, reverse-rotation separation means rotating in a direction opposite to the sheet feeding direction, and a sheet processing unit for processing the sheet separated by said conveying rotation means and said reverse-rotation means, said sheet processing device comprising:

a pair of supporting members for supporting the reverse-rotation separation means by engaging with both ends of a shaft portion thereof, said pair of supporting members provided at a main body of said sheet processing device, at least one of said pair of supporting members being a movable supporting member movable axially along the shaft portion so that the reverse-rotation separation means is detachable when said movable supporting member is moved in a separating direction to separate it from the shaft portion; and regulation means for regulating the movement of said movable supporting member in the separating direction by abutting against said movable supporting member in a direction opposite to the separating direction at a regulating position, when said movable supporting member engages with the shaft portion, and said regulation means being movable in a direction non-parallel to the separating direction thereby moving between the regulating position and a non-regulating position in which said movable supporting member can be disengaged from the shaft portion.

13. A device according to claim 12, wherein the conveying rotation means and the reverse-rotation separation means are provided in a sheet feeding device at an upper portion of the main body of said sheet processing device, wherein a sheet processing unit for processing a sheet fed from the sheet feeding device and discharging means for discharging the processed sheet are provided at a lower portion of the main body of said device, and wherein the sheet feeding device and said sheet processing unit are connected by a U-shaped conveying channel.

14. A device according to claim 12 or 13, wherein said sheet processing unit further comprises an image reading device for reading an image informed on a sheet.

15. A roller supporting device for supporting a roller having a shaft portion with two ends and a roller portion on a main body of said device, said device comprising:

a pair of supporting members for supporting the roller by each engaging with a respective end of the shaft portion, at least one of said pair of supporting members being a movable supporting member movable axially along the shaft portion so that the roller can be detached by moving said movable supporting member in a separating direction to separate it from the shaft portion;

an opening receiving the roller in the main body; and a cover for covering said opening;

wherein said cover has regulation means for regulating the movement of said movable supporting member in the separating direction when said movable supporting member engages with the shaft portion, wherein said movable supporting member is disengaged from the shaft portion when said cover is removed from said opening.

16. A device according to claim 15, wherein said regulation means is a regulation wall mounted to said cover for fixedly holding said movable supporting member.

17. A device according to claim 15, wherein said cover can be detached from the main body and said cover is mounted to the main body by snap engagement.

18. A sheet feeding device having conveying rotation means rotating in a sheet feeding direction, and reverse-rotation means, rotating in a direction opposite to the sheet feeding direction, for separating sheets between the conveying rotation means and the reverse-rotation separation means one by one, said device comprising:

a pair of supporting members for supporting the reverse-rotation separation means by engaging with both ends of a shaft portion thereof, said pair of supporting members provided at a main body of said sheet feeding device, at least one of said pair of supporting members being a movable supporting member movable axially along the shaft portion so that the reverse-rotation separation means is detached by moving said movable supporting member in a separating direction to separate it from the shaft portion;

an opening receiving said reverse-rotation separation means in the main body; and a cover for covering said opening;

wherein said cover has regulation means for regulating the movement of said movable supporting member in the separating direction when said movable supporting member engages with the shaft portion, wherein said movable supporting member is disengaged from the shaft portion when said cover is removed from said opening.

19. A device according to claim 18, wherein the ends of said shaft portion of the reverse-rotation separation means comprises engaging holes formed in axial direction of said shaft portion, and said pair of supporting members supporting the reverse-rotation separation means by engaging with the engaging holes.

20. A sheet processing device having conveying rotation means rotating in a sheet feeding direction, reverse-rotation means, rotating in a direction opposite to the sheet feeding direction, for separating sheets between the conveying rotation means and the reverse-rotation separation means one by one, and a sheet processing unit for processing the sheet separated by said conveying rotation means and said reverse-rotation means, said sheet processing device comprising:

a pair of supporting members for supporting the reverse-rotation separation means by engaging with both ends of a shaft portion thereof, said pair of supporting members provided at a main body of said sheet feeding device, at least one of said pair of supporting members being a movable supporting member movable axially along the shaft portion so that the reverse-rotation separation means is detached by moving said movable supporting member in a separating direction to separate it from the shaft portion;

an opening receiving the reverse-rotation separating means in the main body; and a cover for covering said opening;

wherein said cover has regulation means for regulating the movement of said movable supporting member in the separating direction when said movable supporting member engages with the shaft portion, wherein said movable supporting member is disengaged from the shaft portion when said cover is removed from said opening.

21. A device according to claim 20, wherein said processing unit has an image reading portion for reading of an image on the sheet separated one by one between the conveying rotation means and the reverse-rotation separation means.

* * * * *

UNITED STATES PATENT AND TRADEMARK OFFICE

CERTIFICATE OF CORRECTION

PATENT NO. : 6,059,280

DATED : May 9, 2000

INVENTOR(S): TSUYOSHI YAMAUCHI, ET AL.

It is certified that error appears in the above-identified patent and that said Letters Patent is hereby corrected as shown below:

COLUMN 2:

Line 27, "rollers" should read --roller--.
Line 63, "member" should read --members--.

COLUMN 4:

Line 30, "prespective" should read --perspective--.

COLUMN 11:

Line 55, "dashedd" should read --dashed--.

COLUMN 12:

Line 25, "raise" should read --rise--.
Line 62, "than other" should read --than the other--.

COLUMN 14:

Line 32, "ported" should be deleted.

COLUMN 16:

Line 23, "supprting" should read --supporting--.

UNITED STATES PATENT AND TRADEMARK OFFICE

CERTIFICATE OF CORRECTION

PATENT NO. : 6,059,280

DATED : May 9, 2000

INVENTOR(S): TSUYOSHI YAMAUCHI, ET AL.

It is certified that error appears in the above-identified patent and that said Letters Patent is hereby corrected as shown below:

COLUMN 16 (con't.)

Line 24, "enganging" should read --engaging--.

COLUMN 18:

Line 19, "comprises" should read --comprise--.

Signed and Sealed this

Third Day of April, 2001

*Attest:*

Nicholas P. Godici

NICHOLAS P. GODICI

*Attesting Officer*

*Acting Director of the United States Patent and Trademark Office*